US005397242A

United States Patent [19]

Laisne et al.

[11] Patent Number: 5,397,242

[45] Date of Patent: Mar. 14, 1995

[54] PLUG AND SOCKET CONNECTOR SYSTEM WITH PARTICULAR APPLICATIONS IN AVIONICS

[75] Inventors: Christian Laisne, Brette les Pins; Franck Jollivet, St. Berthevin; Thierry Quillet, St. Pavace le Mans, all of France

[73] Assignee: Framatome Connectors International, Paris, France

[21] Appl. No.: 78,973

[22] Filed: Jun. 17, 1993

[30] Foreign Application Priority Data

Jun. 29, 1992 [FR] France ..... 92 07956

[51] Int. Cl.[6] ..... H01R 13/652

[52] U.S. Cl. ..... 439/101; 439/540; 439/607; 439/681

[58] Field of Search ..... 439/607, 608, 101, 540, 439/701, 680, 681, 924, 108

[56] References Cited

U.S. PATENT DOCUMENTS 3,491,330 1/1970 Barnhart et al. ..... 439/681
4,483,575 11/1984 Kruger et al. ..... 439/924
4,781,604 11/1988 Sadigh-Behzadi et al. ..... 439/608
4,904,194 2/1990 Kilsdonk et al. ..... 439/101
4,906,199 3/1990 Twomey et al. ..... 439/607
5,263,876 11/1993 Johnescu et al. ..... 439/701

FOREIGN PATENT DOCUMENTS 1.416.506 9/1965 France .
1.474.721 2/1967 France .
8620526 3/1990 Germany .

*Primary Examiner*—Gary F. Paumen
*Attorney, Agent, or Firm*—Perman & Green

[57] ABSTRACT

The invention concerns a connector system comprising a plug having a first part comprising first signal contact members, a second part comprising first electrical power supply contact members and an intermediate part and a socket having a first part comprising second signal contact members, a second part comprising second electrical power supply contact members disposed to cooperate electrically with the first electrical power supply contact members and an intermediate part. The intermediate part of the plug has a first ground contact member and the intermediate part of the socket has a second .ground contact member to cooperate electrically with the first member.

9 Claims, 3 Drawing Sheets

PLUG AND SOCKET CONNECTOR SYSTEM WITH PARTICULAR APPLICATIONS IN AVIONICS

BACKGROUND OF THE INVENTION

1. Field of the Invention

The present invention concerns a connector member adapted to constitute either a plug or a socket and having a first part comprising members that are preferably signal contact members, a second part preferably comprising electrical power supply contact members and an intermediate part between the first and second parts and comprising at least one polarizer member.

2. Description of the Prior Art

Connector systems of this kind are known in particular from the "ARINC 600" standard covering connectors for aeronautical applications.

Current connectors to the above standard are not designed to provide effective continuity of grounding between the plug and the socket.

SUMMARY OF THE INVENTION

In one aspect the invention consists An a connector member comprising at least one first part comprising first signal contact members, at least one second part comprising second signal and/or electrical power supply contact members and an intermediate part between said first and second parts and comprising polarizer means and ground contact.

In another aspect the invention consists in a connector system comprising first and second connector members wherein each connection member comprises at least one first part comprising first signal contact members, at least one second part comprising second signal and/or electrical power supply contact members and an intermediate part between the first and second parts and comprising polarizer means and a member of at least one pair of ground contacts, the first and second connector members respectively forming a plug and a socket of which the respective first contact members, second contact members and ground contacts are adapted to cooperate electrically with each other.

In a preferred embodiment of the invention the respective ground contacts are disposed so that when the plug and the socket are assembled together to cooperate electrically the pair of ground contacts provide electrical grounding continuity when there remains a minimal clearance between the first signal contact members of the plug and the socket. This ensures that continuity of grounding is established before the signal contact members are interconnected and necessarily before the power supply contact members at the opposite end are interconnected.

Advantageously, the first part of the plug comprises at least a first mechanical coupling section surrounding its first signal contact members, the first part of socket comprises at least a second mechanical coupling section surrounding its first signal contact members, one of the first and second coupling sections has a male type configuration, the other of the coupling sections has a female type configuration and the mechanical coupling sections also constitute electromagnetic shielding.

Advantageously, the second part of the plug comprises a third mechanical coupling section surrounding its second contact members, the second part of the socket comprises a fourth mechanical coupling section surrounding its second signal and/or electrical power supply contact members, one of the third and fourth coupling sections has a male type configuration, the other of the coupling sections has a female type configuration and the mechanical coupling sections also constitute electromagnetic shielding.

In a particularly advantageous variant of the preferred embodiment the first and second coupling sections and the pair of ground contacts are so disposed that the minimal clearance is obtained in a position in which the first coupling section is in contact with the second coupling section at an end opposite the respective intermediate parts of the plug and the socket and longitudinal axes of the plug and the socket are at a non-null angle to each other.

In a particularly advantageous embodiment of the invention the plug and the socket constituting a connector system in accordance with the invention can only be fitted to each other and consequently cannot be connected to similar members that do not comprise any ground connection.

In a first embodiment of the invention the second ground contact member of the socket is a bushing whose shape is such that the polarizer finger of a standard plug abuts against the bush.

In another embodiment the plug comprises a cylindrical finger coaxial with a polarizer finger of a standard plug so that the cylindrical finger abuts against a polarizer eye of a standard socket without a ground pin carried by the plug abutting against the standard socket.

Optionally, the plug has at least one ground pin, a standard polarizer finger and a cylindrical finger and the socket comprises a ground bushing disposed to cooperate with the ground pin, a standard polarizer eye disposed to cooperate mechanically with the polarizer finger and a cylindrical opening disposed to cooperate with the cylindrical finger.

In a further embodiment the plug comprises two ground contacts and a polarizer finger and the socket has two ground contacts disposed to cooperate electrically with the two ground contacts of the plug and a polarizer eye adapted to couple mechanically with the polarizer finger.

Other features and advantages of the invention will be better understood from the following description given by way of non-limiting example with reference to the drawings.

DETAILED DESCRIPTION OF THE INVENTION

Figure 1:
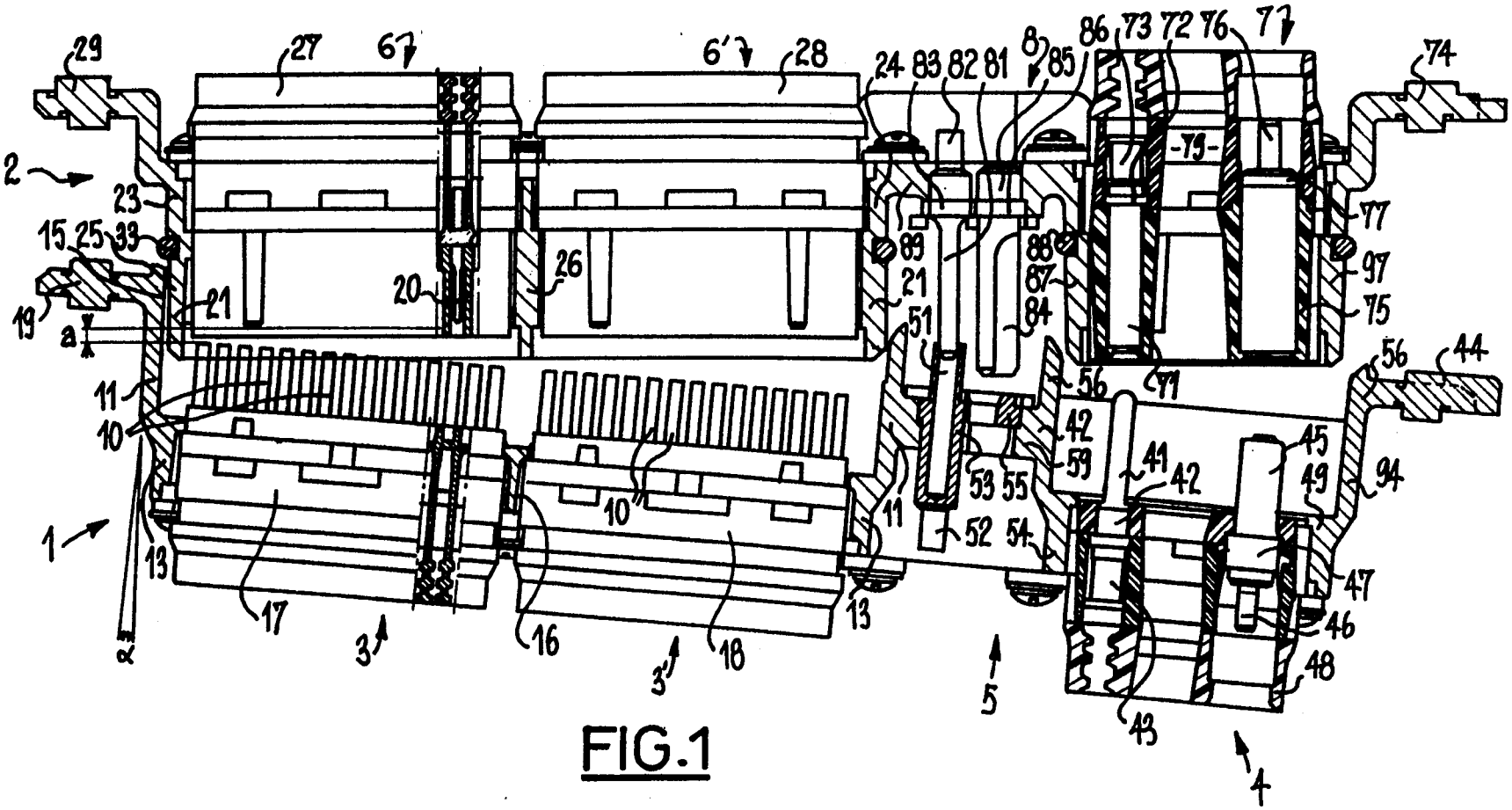
FIG. 1 shows a system in accordance with the invention comprising a plug and a socket partially in longitudinal cross-section.

Referring to FIG. 1, a socket 1 is adapted to receive a plug 2. The socket 1 has a first region comprising two coupling sectors 3 and 3' each receiving male or female contact members 10 housed in respective insulative bodies 17 and 18. The base also has a second region comprising electrical power supply contacts 41 and 45 accommodated in respective insulative bodies 42 and 47 and the respective rear parts 43 and 46 of which surrounded with insulation 48 are adapted to receive power supply cables. The power supply contacts are accommodated in a second coupling region 4. Likewise the plug 2 comprises coupling sectors 6 and 6' respectively in corresponding relationship to the coupling regions 3 and 3' of the socket 1 and which comprise electrical contact members 20 of the type complementary to the contact members 10 and which are accommodated in respective insulative bodies 27 and 28. The plug also has a second part comprising electrical power supply contacts 71 and 75 accommodated in respective insulative bodies 72 and 77 and the respective rear parts 73 and 76 of which are adapted to receive power supply cables. The first part of the socket 1 is delimited by a substantially rectangular contour 11 which in longitudinal cross-section has an elongated U-shape, which surrounds the contacts 10 and which cooperates with a respective contour 21 of the body of the plug 2. The contours 11 and 21 form two complementary mechanical coupling sections. The contours 11 and 21 usually contribute to electromagnetic shielding. As shown the contour 21 is of the male type and the contour is of the female type. The same applies around the second electrical power supply region for which the socket 1 comprises a substantially square cross-section contour 56 to surround the electrical power supply contacts 41 and 45 and which cooperates with a contour 87 also of substantially square cross-section of the plug 2. The contours 56 and 87 form two complementary mechanical coupling sections which may also contribute to electromagnetic shielding. As shown the contour 87 is of the male type and the contour 56 is of the female type. The socket 1 comprises between the coupling sector 3' of the contacts 10 and the coupling sector 4 of the electrical power supply contacts an intermediate region 8 which in standard "ARINC 600" connectors provides polarizer functions. The polarizer function is preferably retained and here is implemented by a standard polarizer finger 84 in the plug 2 cooperating with a standard polarizer eye 55 facing it in the socket 1. The contours 11 and 56 of the socket are parts of a common metal socket body in which are housed the insulative bodies 17 and 18 separated by a flange 16, the electrical power supply contact members being housed in openings in a region 49, the standard polarizer eye 55 being formed in a region 59. The same goes for the plug 2 in which the insulative bodies 27 and 28 are housed in a plug body and separated by a flange 26, electrical power supply contacts are housed in a region 79 and the standard polarizer finger 84 is housed (for example crimped) at 86 in a region 89 of the plug body.

Figure 2:
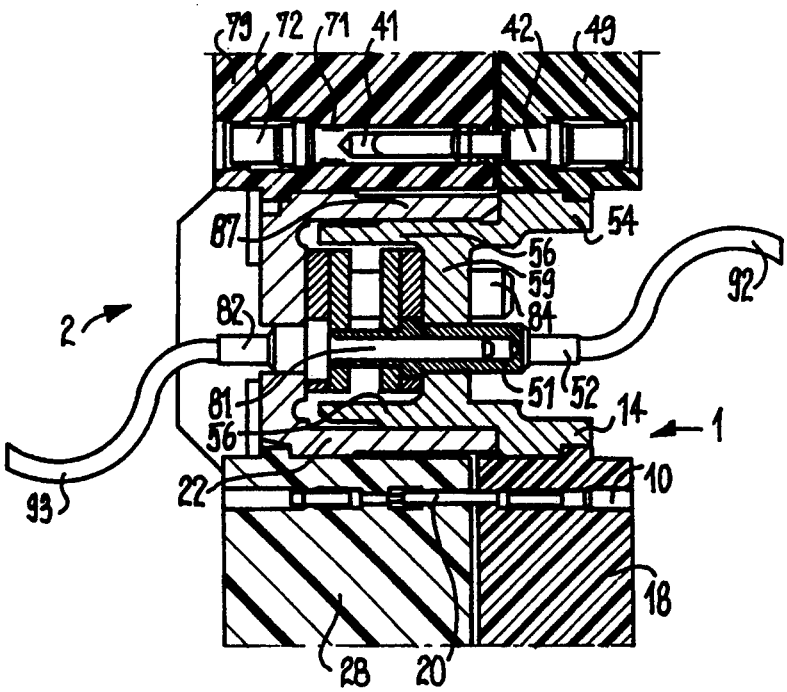
FIG. 2 shows the assembled connector system in accordance with the invention in transverse cross-section and shows the continuity of grounding.

According to the invention the region 59 also comprises a ground contact bushing or bush 51 crimped at 53 in the region 59 and having a rear portion 52 adapted to receive a ground contact wire 92 (FIG. 2). The plug 2 comprises in the region 89 a ground contact pin 81 crimped at 83 and having a rear part 82 adapted to be connected to a ground contact wire 93 (FIG. 2).

As shown in FIG. 1 the ends of the contours 11 and 21 are in contact with each other and 15 and 25 and the ground contact bush 51 and pin 81 are in electrical contact. In this position the lengths of the pin 81 and the bush 51 are such that a clearance at least equal to a remains between the closest together contacts 10 and 20 although continuity of electrical grounding is already provided by the members 51 and 81. Thus in all circumstances ground contact is made (or broken) when the members 10 and 20 are not (or no longer) in electrical contact. This feature avoids electrical incidents when connecting or disconnecting the plug 2 and the socket 1.

The clearance a is preferably at least 1.5 mm which represents the norm for air insulation. In other words, in this case the ground connection must be made unambiguously before the distance between the closest together contacts 10 and 20 is less than 1.5 mm. Even if electromagnetic shielding is employed, potential differences can occur between the signal contacts of the plug and the socket which are sufficiently strong to damage circuits connected to the signal contacts. These potential differences may be high enough to cause electrical arcing between two signal contacts 10 and 20. This is prevented by achieving electrical grounding continuity before the contacts 10 and 20 come together.

FIG. 2 shows a system comprising a plug 2 and a socket i in the connected condition providing grounding continuity between the cables 92 and 93 and a polarizer function (finger 84).

Figure 3A:
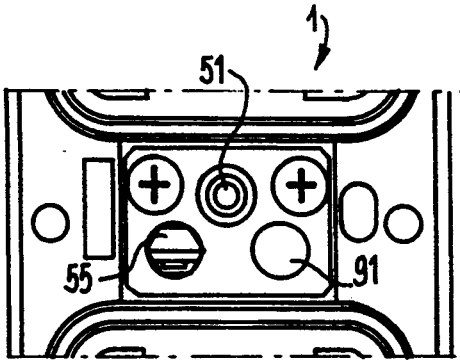
FIGS. 3*a* and 3*b* show one embodiment with polarizer means distinguishing connector system devices in accordance with the invention from similar devices having no ground contact.
Figure 3B:
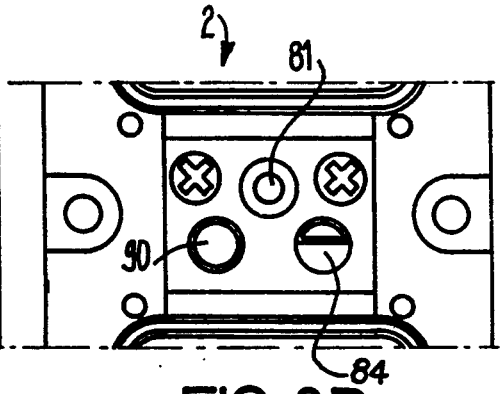

FIGS. 3*a* and 3*b* show a socket 1 and a plug 2 implementing a polarizer function between each other and also with respect to standard "ARINC 600" plugs and sockets which do not have any ground contact. To this end the socket 1 has a ground contact bush 51, a standard polarizer eye 55 and a circular opening 91 arranged in a triangle. Likewise the plug 2 comprises a ground pin 81 adapted to cooperate with the bush 51, a standard polarizer finger 84 adapted to cooperate with the polarizer eye 55 of the socket 1 and a cylindrical finger 90 whose diameter matches that of opening 91 in the socket 1. These members implement a polarizer function both between a plug in accordance with the invention and a standard socket and between a socket in accordance with the invention and a standard plug.

Figure 4A:
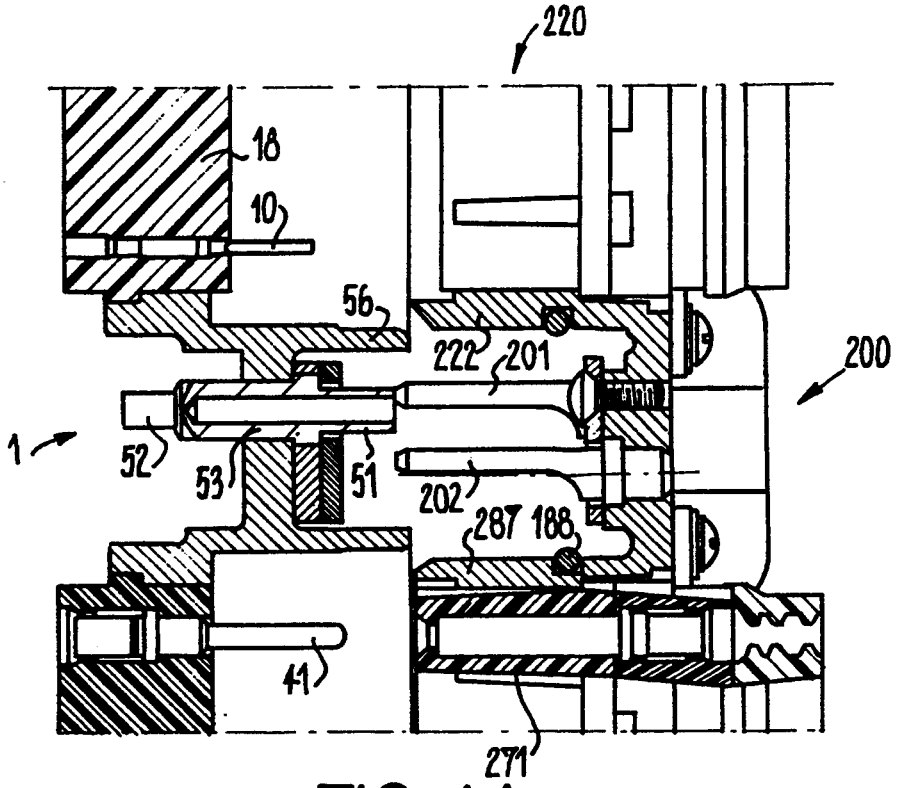
FIGS. 4*a* and 4*b* respectively show the operation of the polarizer means upon interaction between a socket in accordance with the invention and a standard plug and between a plug in accordance with the invention and a standard socket.
Figure 4B:
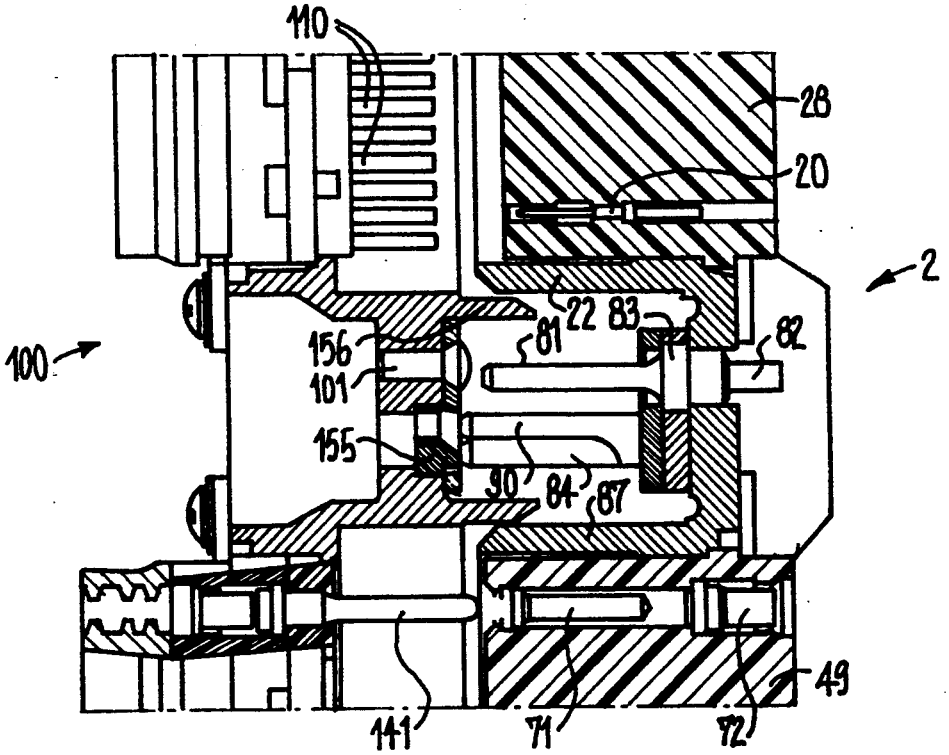

FIGS. 4*a* and 4*b* shows that these two functions can be implemented in combination or separately.

In FIG. 4*a* a polarizer function is implemented between a socket in accordance with the invention and a standard plug by virtue of the fact that, on attempting to connect a socket 1 and a standard plug 200, the hermaphrodite polarizer finger 201 abuts on the outside edge of the bush 51, so preventing connection.

In FIG. 4*b* connection between a plug 2 in accordance with the invention and a standard socket 100 is prevented by virtue of the fact that the cylindrical polarizer finger 90 on the plug 2 cannot enter the polarizer eye 155 facing it in the standard socket 100. Specifically, given that the cylindrical polarizer finger is longer than the pin 81, the latter does not abut against the standard plug 100 which protects it from being damaged in this situation.

Figure 5A:
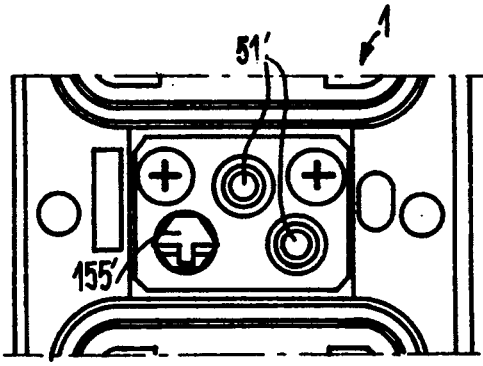
FIGS. 5*a* and 5*b* show another embodiment with polarizing means distinguishing connector system devices of the invention from similar devices having no ground contact.
Figure 5B:
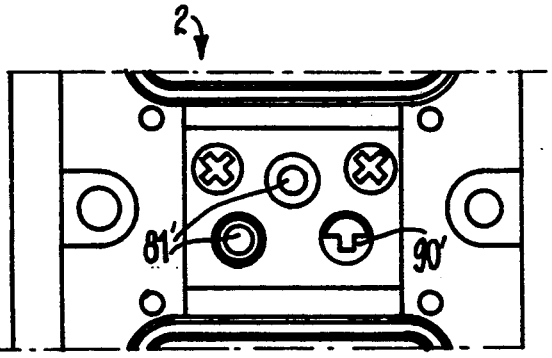

In FIGS. 5*a* and 5*b* the socket 1 comprises two ground bushes 51' and a polarizer eye 155' and the plug 2 comprises two ground pins 81' facing the bushes 51 and a polarizer finger 90' facing the polarizer eye 155' and having a polarizer profile (T-shape in this example)

complementary to the latter to enable them to be coupled together. As previously, the socket 1 cannot be assembled to a standard plug and the plug 2 cannot be inserted in a standard socket.

There is claimed:

1. Connector system comprising first and second connector members wherein each connector member comprises at least one first part having first signal contact members, at least one second part having second contact members, and an intermediate part between said first and second parts, said intermediate part comprising a polarizer means and a separate ground contact member, said first and second connector members respectively forming a plug and a socket of which the respective first contact members, second contact members and ground contact members are adapted to cooperate electrically with each other, wherein said first part of said plug comprises at least a first mechanical coupling section surrounding its first signal contact members, said first part of said socket comprises at least a second mechanical coupling section surrounding its first signal contact members, one of said first and second coupling sections has a male type configuration, the other of said coupling sections has a female type configuration and said mechanical coupling sections also constitute electromagnetic shielding.

2. Connector system according to claim 1 wherein said respective ground contact members are disposed so that, when said plug and said socket are assembled together to cooperate electrically, said ground contact members provide electrical grounding continuity when there remains a minimal clearance between said first signal contact members of said plug and said socket.

3. Connector system according to claim 1 wherein said second part of said plug comprises a third mechanical coupling section surrounding its second contact members, said second part of said socket comprises a fourth mechanical coupling section surrounding its second contact members, one of said third and fourth coupling sections has a male type configuration, the other of said third and fourth coupling sections has a female type configuration and said third and fourth mechanical coupling sections also constitute electromagnetic shielding.

4. Connector system according to claim 1 wherein said first and second coupling sections and said ground contact members are so disposed that minimal clearance is obtained in a position in which said first coupling section is in contact with said second coupling section at an end opposite said respective intermediate parts of said plug and said socket and, longitudinal axes of said plug and said socket are at a non-null angle to each other.

5. Connector system according to claim 1 wherein said ground contact member of said socket is a bushing whose shape is such that a polarizer finger of a standard plug abuts against said bushing.

6. Connector system according to claim 1 wherein said plug comprises a cylindrical finger coaxial with a polarizer finger of a standard plug so that said cylindrical finger abuts against a polarizer eye of a standard socket without a ground pin carried by said plug abutting against said standard socket.

7. Connector system according to claim 1 wherein said plug has at least one ground pin, a standard polarizer finger and a cylindrical finger and said socket comprises a ground bushing disposed to cooperate with said ground pin, a standard polarizer eye disposed to cooperate mechanically with said polarizer finger and a cylindrical opening disposed to cooperate with said cylindrical finger.

8. Connector system according to claim 1 wherein said plug comprises two first members of two pairs of ground contacts and a polarizer finger and said socket has two second members of said pairs of ground contacts disposed to cooperate electrically with said two first members and a polarizer eye adapted to couple with said polarizer finger.

9. A connection system having a first plug connector and a mating second socket connector, each of the connectors comprising:

a first section having first contact members and a mechanical coupling section surrounding the first contact members, the mechanical coupling section forming an electromagnetic shield for the first contact members;

a second section having second contact members; and an intermediate section between the first and second sections, the intermediate section having polarizer means and a ground contact, wherein one of the coupling sections has a male type configuration and the other one of the coupling sections has a female type configuration.

* * * * *